US008322153B2

(12) United States Patent
Lee

(10) Patent No.: US 8,322,153 B2
(45) Date of Patent: Dec. 4, 2012

(54) REFRIGERATOR AND ICE MAKING ASSEMBLY THEREOF

(75) Inventor: Bok-Dong Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 691 days.

(21) Appl. No.: 12/523,887

(22) PCT Filed: Jan. 21, 2008

(86) PCT No.: PCT/KR2008/000375

§ 371 (c)(1),
(2), (4) Date: Jul. 21, 2009

(87) PCT Pub. No.: WO2008/091087

PCT Pub. Date: Jul. 31, 2008

(65) Prior Publication Data

US 2010/0107664 A1 May 6, 2010

(30) Foreign Application Priority Data

Jan. 22, 2007 (KR) ..... 10-2007-0006689

(51) Int. Cl.
*F25C 1/00* (2006.01)
*F25C 5/02* (2006.01)

(52) U.S. Cl. ..... 62/137; 62/344

(58) Field of Classification Search ..... 62/66, 135, 62/137, 344
See application file for complete search history.

(56) References Cited

U.S. PATENT DOCUMENTS

2007/0186571 A1* 8/2007 Kopf ..... 62/135

FOREIGN PATENT DOCUMENTS

| | | | |
|---|---|---|---|
| JP | 5-133656 | A | 5/1993 |
| JP | 6-11228 | A | 1/1994 |
| KR | 10-2000-0021989 | A | 4/2000 |
| KR | 10-2005-0026635 | A | 3/2005 |
| KR | 10-2005-0028228 | A | 3/2005 |

* cited by examiner

*Primary Examiner* — Marc Norman
(74) *Attorney, Agent, or Firm* — Birch, Stewart, Kolasch & Birch, LLP

(57) ABSTRACT

An ice making assembly according to the preferred embodiments of the present invention is characterized in that the operation of the sensing lever for measuring the storage amount of ice is smoothly activated, and that the amount of ice stored in the container is accurately measured.

21 Claims, 3 Drawing Sheets

[Fig. 1]
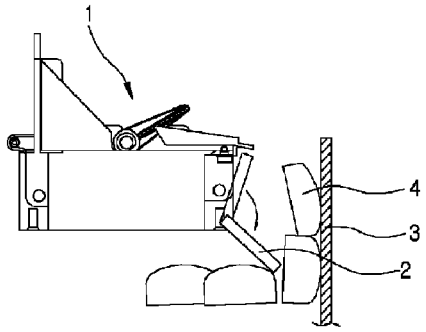
[Fig. 2]
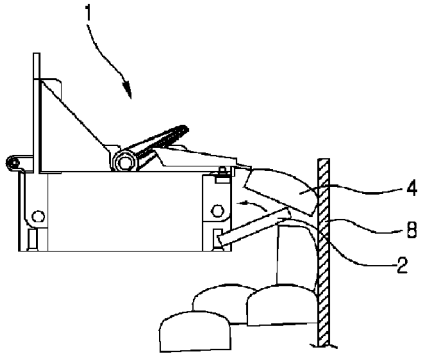
[Fig. 3]
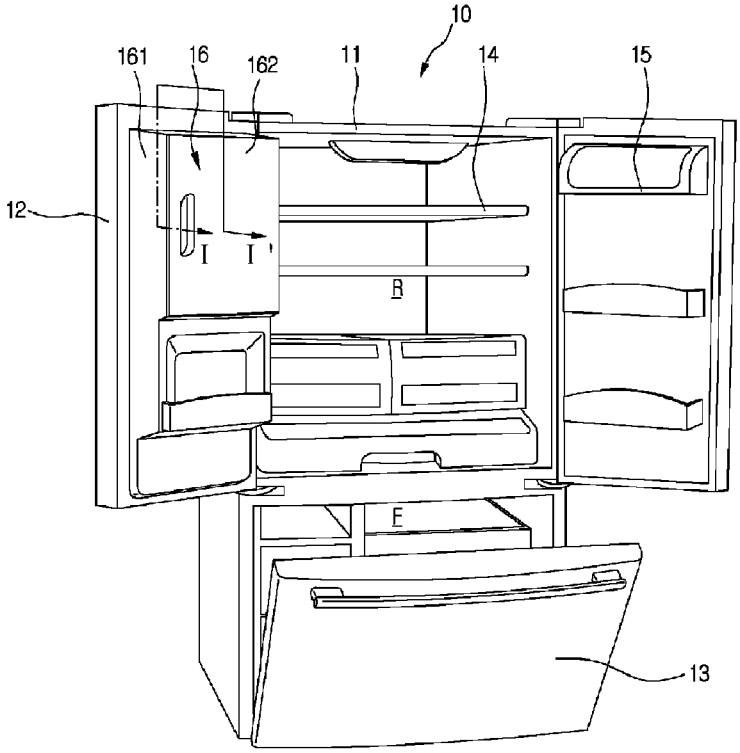

[Fig. 4]
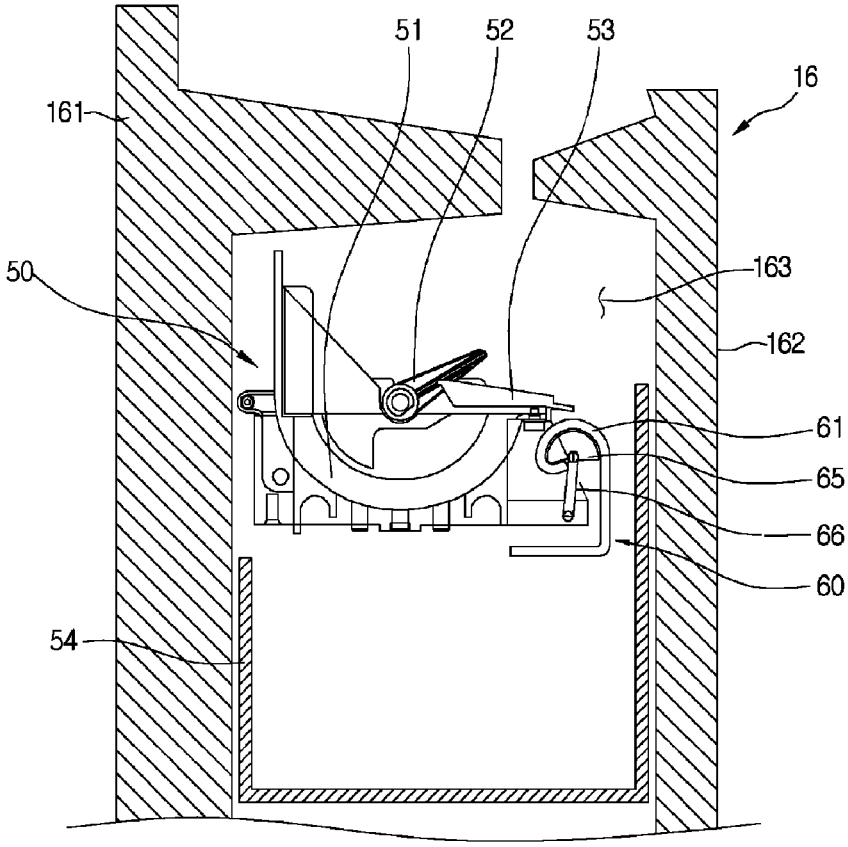
[Fig. 5]
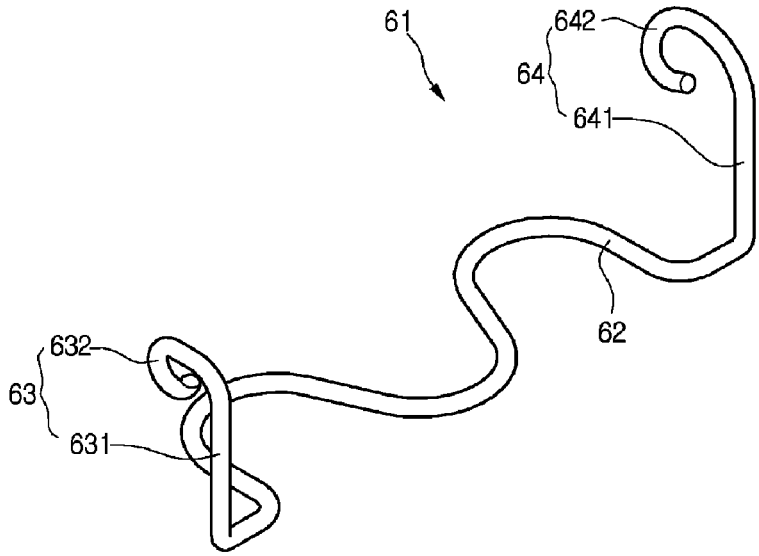

[Fig. 6]
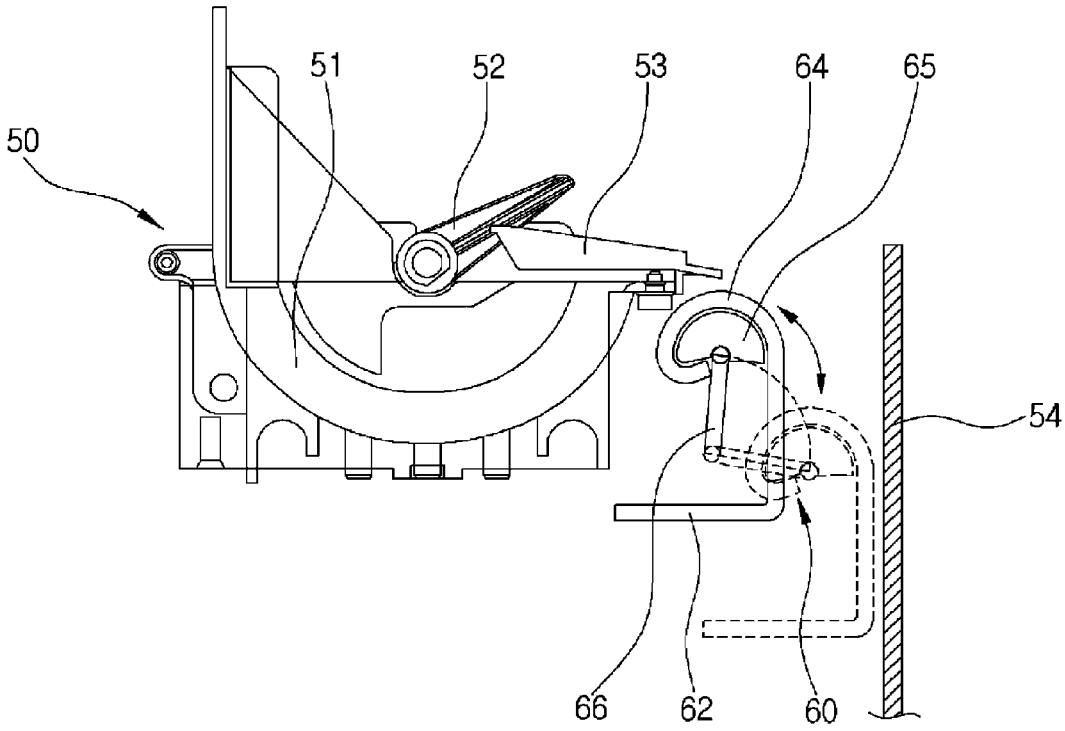

REFRIGERATOR AND ICE MAKING ASSEMBLY THEREOF

TECHNICAL FIELD

This document relates to an ice making assembly capable of measuring an amount of ice with accuracy and a refrigerator having the same.

BACKGROUND ART

Generally, a refrigerator is an appliance, which is used to store foodstuffs for a long period of time in a fresh state, and is provided with a freezing chamber for freezing and storing foodstuffs, a refrigerating chamber for refrigerating and storing foodstuffs and a refrigeration cycle for refrigerating the freezing and refrigerating chambers, and the operation of the refrigerator is controlled by a control unit embedded therein.

FIGS. 1 and 2 show the operation state of an ice sensing lever of a conventional ice making assembly.

Referring to FIGS. 1 and 2, the conventional ice making assembly includes an ice maker 1, a container 3 in which ice is stored, and a sensing lever 2 for sensing the amount of ice stored in the container 3.

Specifically, the sensing lever 2 is rotated in order to sense the amount of ice stored in the container 3. And, the rotation of the sensing lever 2 is stopped when an end of the sensing lever 2 is contacted with ice, and the amount of ice is measured according to the amount of rotation of the sensing lever 2. Further, the sensing lever 2 is formed in the shape of '□' and both ends thereof are rotatably connected to both sides of the ice maker 1. Further, the sensing lever 2 is rotated by a drive motor.

According to the conventional sensing lever aving the above mentioned structure, as shown in FIG. 2, there is a problem in that the sensing lever 2 is not smoothly operated if ice 4 stored and stood against a wall of the container 3 is dropped into the sensing lever 2. Otherwise, there is another problem in that the amount of ice to be sensed is overestimated although the amount of ice stored therein is not sufficient, if ice cubes are stacked only on a front of the container 3 rather than they are evenly stacked on top of each other.

DISCLOSURE OF INVENTION

Technical Problem

The present invention is derived to resolve these problems and it is an object of the present invention to provide an ice making assembly capable of measuring the amount of ice with accuracy and a refrigerator having the same.

Also, another object of the present invention is to provide an ice making assembly for preventing a sensing lever, which senses the amount of ice, from being restricted by ice stored in a container and a refrigerator having the same.

Also, further another object of the present invention is to provide an ice making assembly having a sensing lever for evenly distributing and stacking ice cubes dropped into a container onto the inside of the container and a refrigerator having the same.

Technical Solution

To achieve these and other advantages and in accordance with the purpose of the present invention, as embodied and broadly described herein, there is provided an ice making assembly, including: an ice making vessel in which ice is formed; an ice moving lever for separating ice generated in the ice making vessel; a container in which ice separated by the ice moving lever is stored; and an ice sensing unit provided with a sensing lever for measuring the amount of ice stored in the container, wherein the sensing lever rises up and falls down in the same state as it was at the beginning.

According to another aspect of the present invention, there is provided an ice making assembly, including: an ice making vessel in which ice is formed; an ice moving lever for separating ice generated in the ice making vessel; a container in which ice separated by the ice moving lever is stored; a sensing lever for measuring the amount of ice stored in the container; and a rotation shaft for guiding the lift-and-fall of the sensing lever, wherein the sensing lever includes a sensing part which is extended in a horizontal direction and a pair of connection parts which are vertically extended from both ends of the sensing part.

Advantageous Effects

By virtue of the ice making assembly according to the preferred embodiment of the present invention constructed as such, the amount of ice stored in the container is accurately measured.

Also, by virtue of the ice making assembly according to the preferred embodiment of the present invention, the amount of ice stored in the container can be detected in a larger area.

Also, by virtue of the ice making assembly according to the preferred embodiment of the present invention, ice cubes are evenly distributed in the container.

Also, there is an advantage in that the restriction of rotation of the sensing lever due to falling ice is prevented.

BRIEF DESCRIPTION OF THE DRAWINGS

FIGS. 1 and 2 are views showing the operation state of an ice sensing lever of a conventional ice making assembly.

FIG. 3 is a perspective view showing a refrigerator having an ice making assembly according to a preferred embodiment of the present invention.

FIG. 4 is a cross-sectional view taken along line I-I' of FIG. 3.

FIG. 5 is a perspective view showing a sensing lever according to a preferred embodiment of the present invention.

FIG. 6 is a view showing the operation state of an ice sensing unit according to a preferred embodiment of the present invention.

MODE FOR THE INVENTION

Hereinafter, the concept of the present invention will be explained in detail with reference to specific embodiments. However, it is noted that the concept of the present invention is not to be limited to these embodiments and those skilled in the art will appreciate that various modifications, additions and substitutions are possible, without departing from the scope and spirit of the invention as disclosed in the accompanying claims.

FIG. 3 shows a refrigerator having an ice making assembly according to a preferred embodiment of the present invention in a perspective view.

Hereinafter, a refrigerator, in which a freezing chamber is disposed at a lower side of the of the refrigerator and an ice making assembly is installed at a rear surface of a refrigerating chamber door, will be explained for example. However, the ice making assembly according to the embodiment of the present invention may be applied to any other type of refrigerator. That is, the ice making assembly according to the present invention may be provided in the refrigerating chamber or freezing chamber, or it may be provided at the refrigerating chamber door or freezing chamber door.

Referring to FIG. 3, the refrigerator according to the preferred embodiment of the present invention includes a body 11 in which a freezing chamber F is disposed at a lower side of the of the refrigerator and a refrigerating chamber R is disposed at an upper side, a refrigerating chamber door 12 for selectively opening/closing the refrigerating chamber R, a freezing chamber door 13 for selectively opening/closing the freezing chamber F, a door basket 15 installed at the rear surface of the refrigerating chamber door 12, and an ice making assembly 16 installed at the rear surface of the refrigerating chamber door 12.

Specifically, the ice making assembly 16 is composed of an ice making room 161 in which a structure for an ice making chamber 163 (see FIG. 4) is accommodated, and a cover 162 opening/closing the ice making room 161. The inner structure of the ice making room 161 will be explained in detail with reference to the drawings.

FIG. 4 shows a cross-sectional view taken along line I-I' of FIG. 3.

Referring to FIG. 4, the ice making chamber 163 is formed in the ice making assembly 16 according to the embodiment of the present invention, and an ice maker 50 and a container 54 provided at a lower side of the ice maker 50 to receive ice are installed in the ice making chamber 163.

Specifically, the ice maker 50 includes an ice making vessel 51 in which water for making ice is stored, an ice moving lever 52 separating ice formed in the ice making vessel 51, a guide 53 for safely dropping the moved ice into the container 54, and an ice sensing unit 60 for measuring the amount of ice stored in the container 54.

More specifically, the ice sensing unit 60 includes a sensing lever 61 contacting to ice, a rotation shaft 66 rotating the sensing lever 61, and a cam 65 pivotably provided at one end of the rotation shaft 66. And, the other end of the rotation shaft 66 is rotatably connected to a lower side of the front surface of the ice maker 50. Further, the amount of rotation of the rotation shaft 66 is controlled by a drive motor (not shown).

FIG. 5 shows a sensing lever according to a preferred embodiment of the present invention in a perspective view.

Referring to FIG. 5, the sensing lever 61 according to the preferred embodiment of the present invention is composed of a sensing part 62 which is directly contacted with ice, and a connection part which is upwardly extended from both ends of the sensing part 62.

Specifically, the sensing part 62 always maintains the horizontal state when it is installed in the ice maker 50. And, the connection part includes a first connection part 63 which is extended from one end of the sensing part 62 and is rotatably connected to an end of the rotation shaft 66, and a second connection part 64 which is extended from the other end of the sensing part 62 and is indirectly connected to the rotation shaft 66 via the cam 65.

Here, the first and second connection parts 63, 64 are connected to both ends of the ice maker 50, respectively. That is, the rotation shaft 66 is rotatably connected to both ends of the ice maker 50, and the first and second connection parts 63, 64 are connected to the respective end of the rotation shaft 66.

Meanwhile, the first connection part 63 includes an extension part 631 which is vertically extended from the sensing part 62, and a hinge insertion part 632 which is bent from the end of the extension part 631. Here, the hinge insertion part 632 serves to insert a hinge provided at the end of the rotation shaft 66 into the hinge insertion part 632.

Also, the second connection part includes an extension part 641 which is vertically extended from the sensing part 62, and a cam receiver 642 which is bent from the end of the extension part 641.

Specifically, the cam 65 is rotatably connected to the end of the rotation shaft 66, and the cam 65 is fitted into the cam receiver 642. Therefore, the cam receiver 642 is bent to have the same curvature as that of the cam 65, and it surrounds the cam 65.

Also, the sensing part 62 is formed in a back and forth meander configuration as shown in the drawing, and therefore it may be contacted with ice at a larger area. That is, if the sensing part 62 is contacted with ice at a larger area, the amount of ice stored in the container 54 can be accurately detected. Also, by increasing the curvature of the sensing part 62, the falling ice may be prevented from being stuck into the sensing part 62. Further, the operation of the sensing part 62 may be prevented from being restricted due to the stored ice, as the sensing part 62 is configured not to rotate but to translate in a vertical direction.

Also, according to the present embodiment, the rotation shaft is directly connected to the extension part which is extended from one end of the sensing part 62 and the rotation shaft is indirectly connected to the extension part which is extended from the other end via the cam, however the present invention is not restricted thereto. That is, all of the extension parts connected to both ends of the sensing part 62 are directly connected to the rotation shaft 66, or they are indirectly connected thereto via the cam 65.

Hereinafter, the operation of the ice sensing unit 60 will be explained in detail with reference to the accompanying drawings.

FIG. 6 shows the operation state of the ice sensing unit according to the preferred embodiment of the present invention.

The ice making and separating processes will be explained with reference to FIG. 6.

First, water is supplied to the ice making vessel 51 through a water supply means, and the ice making process is progressed. And, after finishing the ice making process, ice is separated from the ice making vessel 51 as a heater for ice making (not shown) is operated and, at the same time, ice is scooped up as the ice moving lever 52 is rotated. Further, the scooped ice is dropped into the container 54 along the guide 53.

Also, the rotation shaft 66 is rotated in a clockwise direction, as the drive motor connected to the rotation shaft 66 rotates. And then, the sensing lever 61 is going down as shown in the drawing. In other words, the sensing lever 61 simply moves in a vertical direction without rotating, in contrast to the conventional sensing lever.

Specifically, if the rotation shaft 66 is rotated, the cam 65 and the sensing lever 61 descent to the lower side. And, the rotation shaft 66 keeps rotating until the sensing part 62 formed at the lower end of the sensing lever 61 is contacted with ice stored in the container 54. And, if the sensing part 62 no more go down because it is contacted with ice, the storage amount of ice at this point is measured. In other words, the storage amount of ice according to the amount of rotation of the rotation shaft 66 is stored in a memory of a control unit, and the storage amount of ice is measured while comparing the stored data with the actual amount of rotation of the rotation shaft 66.

Also, by virtue of the characteristic of shape of the sensing part 62, the accurate amount of ice can be measure, since the area which is contacted with ice stored in the container 54 is larger than that of the conventional sensing lever.

Here, the cam 65 is integrally moved with the rotation lever 64, however the present invention is not restricted thereto.

In other words, the cam 65 may be rotated in the same direction as that of the rotation shaft 66 during the rotation of the rotation shaft 66. Since the cam 65 is not in the shape of a semicircle but is in the shape of a form having a varying curvature, the center of gyration of the cam 65 is eccentric relative to the the center of gravity. Therefore, the cam 65 can be separately rotated along the inner circumferential surface of the cam receiver 642, when the rotation shaft 66 is rotated. In this case, the cam 65 vertically maintained in the cam receiver 642 at the initial state, and it may be horizontally maintained as it is rotated in a counter-clockwise direction during the rotation of the rotation shaft 66.

The invention claimed is:

1. An ice making assembly, comprising:
an ice making vessel in which ice is formed;
an ice moving lever for separating ice generated in the ice making vessel;
a container in which ice separated by the ice moving lever is stored; and
an ice sensing unit for measuring the amount of ice stored in the container,
wherein the ice sensing unit includes:
a pair of rotation shafts which are rotatably provided at the ice making vessel;
a sensing lever, ends of the pair of rotation shafts configured to be respectively connected to side ends of the sensing lever; and
a drive motor which drives at least one of the pair of rotation shafts, and
wherein the sensing lever rises and falls in a constant configuration.

2. The ice making assembly according to claim 1, further comprising:
a cam which is connected to at least one end of the pair of rotation shafts.

3. The ice making assembly according to claim 1, wherein a lower end of the sensing lever is horizontally maintained during rise and fall.

4. An ice making assembly, comprising:
an ice making vessel in which ice is formed;
an ice moving lever for separating ice generated in the ice making vessel;
a container in which ice separated by the ice moving lever is stored;
a sensing lever for measuring the amount of ice stored in the container; and
a rotation shaft for guiding the lift-and-fall of the sensing lever by means of rotation,
wherein the sensing lever includes a sensing part which is extended in a horizontal direction and a pair of connection parts which are vertically extended from both ends of the sensing part, and
wherein the sensing part is configured as a form which is bent a plurality of times on a horizontal surface.

5. The ice making assembly according to claim 4, wherein each of the pair of connection parts includes:
an extension part which is extended from an end of the sensing part; and
a hinge insertion part which is bent at an end of the extension part and is connected to the rotation shaft.

6. The ice making assembly according to claim 4, wherein the pair of connection parts includes:
a first connection part having an extension part which is extended from one end of the sensing part, and having a hinge insertion part which is bent at an end of the extension part and is connected to the rotation shaft; and
a second connection part having an extension part which is vertically extended from the other end of the sensing part, and having a cam receiver which is bent at the end of the extension part with the curvature different from that of the hinge insertion part.

7. The ice making assembly according to claim 6, further comprising:
a cam which is accommodated in the cam receiver and is connected to the rotation shaft.

8. The ice making assembly according to claim 7, wherein the cam is fixed in the hinge insertion part.

9. The ice making assembly according to claim 7, wherein the cam may be rotated in the hinge insertion part in the opposite direction to that of the rotation shaft.

10. A refrigerator having an ice making assembly, the ice making assembly comprising:
an ice making vessel in which ice is formed;
an ice moving lever for separating ice generated in the ice making vessel;
a container in which ice separated by the ice moving lever is stored; and
an ice sensing unit for measuring the amount of ice stored in the container,
wherein the ice sensing unit includes:
a pair of rotation shafts which are rotatably provided at the ice making vessel;
a sensing lever, ends of the pair of rotation shafts configured to be respectively connected to side ends of the sensing lever; and
a drive motor which drives at least one of the pair of rotation shafts, and wherein the sensing lever rises and falls in a constant configuration.

11. The refrigerator according to claim 10, wherein the ice making assembly is provided in a refrigerating chamber or a freezing chamber.

12. The refrigerator according to claim 10, wherein the ice making assembly is provided at a refrigerating chamber door or a freezing chamber door.

13. The refrigerator according to claim 10, further comprising:
a cam which is connected to at least one end of the pair of rotation shafts.

14. The refrigerator according to claim 10, wherein a lower end of the sensing lever is horizontally maintained during rise and fall.

15. The refrigerator according to claim 10, wherein the sensing lever includes a sensing part which is extended in a horizontal direction and a pair of connection parts which are vertically extended from both ends of the sensing part.

16. The refrigerator according to claim 15, wherein the sensing part is configured as a form which is bent a plurality of times on a horizontal surface.

17. The refrigerator according to claim 15, wherein each of the pair of connection parts includes:
an extension part which is extended from an end of the sensing part; and
a hinge insertion part which is bent at an end of the extension part and is connected to the rotation shaft.

18. The refrigerator according to claim 15, wherein the pair of connection parts include:
a first connection part having an extension part which is extended from one end of the sensing part, and having a hinge insertion part which is bent at an end of the extension part and is connected to the rotation shaft; and a second connection part having an extension part which is vertically extended from the other end of the sensing part, and having a cam receiver which is bent at the end of the extension part with the curvature different from that of the hinge insertion part.

19. The refrigerator according to claim 18, further comprising:

a cam which is accommodated in the cam receiver and is connected to the rotation shaft.

20. The refrigerator according to claim 19, wherein the cam is fixed in the hinge insertion part.

21. The refrigerator according to claim 19, wherein the cam may be rotated in the hinge insertion part in the opposite direction to that of the rotation shaft.

* * * * *